US005987841A

United States Patent [19]

Campo

[11] Patent Number: 5,987,841

[45] Date of Patent: Nov. 23, 1999

[54] WOODEN MASSIVE WALL SYSTEM

[76] Inventor: Joseph M. Campo, 125 Cave Ave., Manitou Springs, Colo. 80829

[21] Appl. No.: 08/746,480

[22] Filed: Nov. 12, 1996

[51] Int. Cl.[6] ..... E04H 12/00

[52] U.S. Cl. ..... 52/648.1; 52/236.3

[58] Field of Search ..... 52/268, 272, 275, 52/277, 279, 210, 648.1, 653.1, 654.1, 236.3

[56] References Cited

U.S. PATENT DOCUMENTS

| | | | |
|---|---|---|---|
| 3,206,903 | 9/1965 | Johnson | 52/653.1 X |
| 3,304,677 | 2/1967 | Pavlecka | 52/277 |
| 4,074,487 | 2/1978 | Daniels et al. | 52/653.1 X |
| 4,130,970 | 12/1978 | Cable | 52/653.1 X |
| 4,514,950 | 5/1985 | Goodson | 52/653.1 |
| 4,671,032 | 6/1987 | Reynolds | 52/210 |
| 4,813,193 | 3/1989 | Altizer | 52/210 |
| 5,095,671 | 3/1992 | Mitani | 52/210 |
| 5,664,380 | 9/1997 | Hsueh | 52/653.1 X |

*Primary Examiner*—Beth Aubrey

*Attorney, Agent, or Firm*—G. F. Gallinger

[57] ABSTRACT

The traditional method of framing energy efficient Southwestern custom built homes entails the framing of an exterior wall and a second wall which is inside the exterior wall. All of this framing is done on site, and most frequently, in less than ideal weather conditions. It is more efficient to erect wall unit assemblies built in the controlled and more productive environment of a shop. A wall unit assembly is built with a multiplicity of double stud units each unit having an interior load bearing vertical stud, and an exterior upright stud, an upper connecting member extending laterally between top end portions of the interior and exterior studs, and a lower connecting member extending laterally between bottom end portions of the interior and the exterior studs. The studs and connecting members preferably are made from dimension lumber, and fastened together by connecting plates. The double stud units are spaced along, and fastened above two parallel footers, and beneath two parallel headers thereby forming a wall unit assembly. Window, door, and straight wall unit assemblies are disclosed so that the walls of an entire building may be quickly erected using these prefabricated unit assembliess.

20 Claims, 2 Drawing Sheets

WOODEN MASSIVE WALL SYSTEM

FIELD OF INVENTION

This invention relates to buildings having well insulated and thick exterior walls which have parallel rows of studs therein. More particularly this invention relates to a wooden residential building construction method for erecting energy efficient buildings with a Southwestern, and Mediterranean or contemporary motif.

BACKGROUND OF THE INVENTION

There is a growing demand for aesthetic energy efficient buildings which require minimal cooling and heating. Residential buildings which have double rows of parallel studs in their exterior walls, so that the interior of these walls may be packed with insulation, and which have the exterior of these walls sprayed with a grout, have a rustic Southwestern appeal, which middle and higher end home buyers want. The traditional method of framing thick walled custom built homes comprises the framing of an exterior wall and a second wall which is inside the exterior wall. All of this framing is done on site, and most frequently, in less than ideal weather conditions. What is needed is a more efficient method of erecting these double exterior walls.

OBJECTS AND STATEMENT OF INVENTION

It is an object of this invention to disclose a an efficient method of erecting massive exterior walls in custom built homes. It is an object of this invention to disclose a method of erecting homes having double rows of parallel studs in their exterior walls so that buildings may be quickly erected with an unusually accurate and predictable cost. It is yet a further object of this invention to disclose a method of framing walls in custom homes, which have been traditionally been erected on site, in the controlled and more productive environment of a shop. It is a final object of this invention to disclose a massive wall system which will dramatically reduce the time and costs of framing custom built homes having exterior walls which comprise a double row of parallel studs.

One aspect of this invention provides for a double stud unit for framing a thick wall which comprises: an interior load bearing vertical stud; an exterior upright stud; an upper connecting member extending laterally between top end portions of the interior and exterior studs; and, a lower connecting member extending laterally between bottom end portions of the interior and exterior studs; wherein the studs and connecting members are dimension lumber, fastened together by connecting plates.

Another aspect of this invention provides for a wall unit assembly for a thick walled building comprising: a multiplicity of double stud units as specified above; further comprising two parallel lateral footers, one positioned beneath the interior studs and the other positioned beneath the exterior studs; and two parallel headers, one positioned above the interior studs, and the other positioned above the exterior studs.

In a preferred aspect of the invention the footers and headers are dimension lumber, connecting plates are used for fastening. A sheathing is fastened to an exterior side portion thereof.

A wooden massive wall system is contemplated in which similarly constructed door, and window wall unit assemblies are disclosed so that the walls of an entire building may be quickly erected using these prefabricated units.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figure 1:
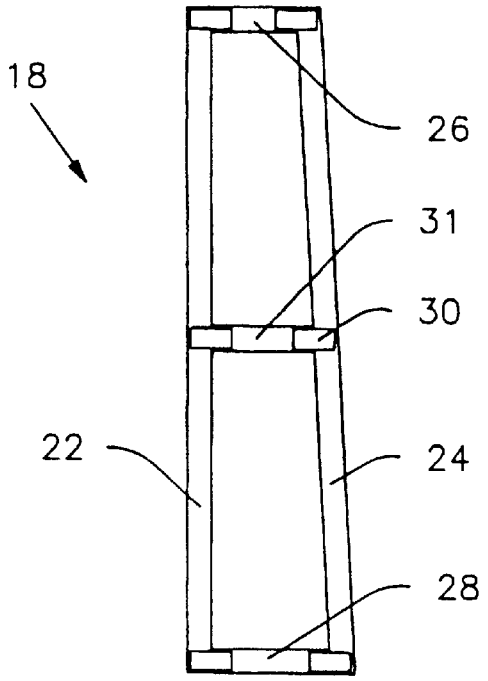
FIG. 1 is an elevational view of an elevational view of a double stud unit, the basic component in the massive wall system.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have an elevational view of a double stud unit 18, the basic component for framing a thick wall in the massive wall system 20. The double stud unit 18 comprises: an interior load bearing vertical stud 22; an exterior upright stud 24; an upper connecting member 26 extending laterally between top end portions of the interior stud 22 and exterior stud 24; and, a lower connecting member 28 extending laterally between bottom end portions of the interior stud 22 and exterior stud 24. In the preferred embodiment the studs 22,24 and connecting members 26,28 are made from dimension lumber, fastened to together by connecting plates 30. Most preferably the upper connecting member 26 is shorter than the bottom connecting member 28 so that the exterior stud 24 slopes with respect to the interior load bearing vertical stud. Most preferably a center connecting member 31 extends between a central portion of the interior stud 22 and exterior stud 24.

Figure 2:
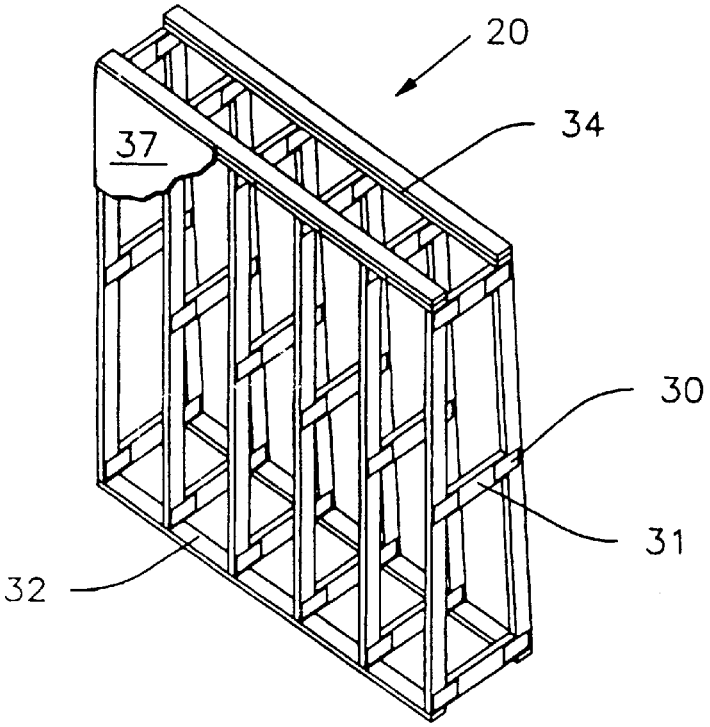
FIG. 2 is a perspective view of a wall assembly.

FIG. 2 is a perspective view of a wall unit assembly 20. The wall unit assembly 20 comprises: a multiplicity of double stud units 18 made from dimension lumber, and fastened together by connecting plates 30; and, double stud units 18 spaced along, and fastened above two parallel lateral footers 32, one of the footers 32 positioned beneath the interior studs 22 and the other positioned beneath the exterior studs 24. The double stud units 18 are also spaced along, and fastened beneath parallel headers 34, one positioned above the interior studs 22, and the other positioned above the exterior studs 24. Sheathing 37 is shown attached to an upper corner portion of the exterior side portion of the wall unit assembly 20.

Figure 3:
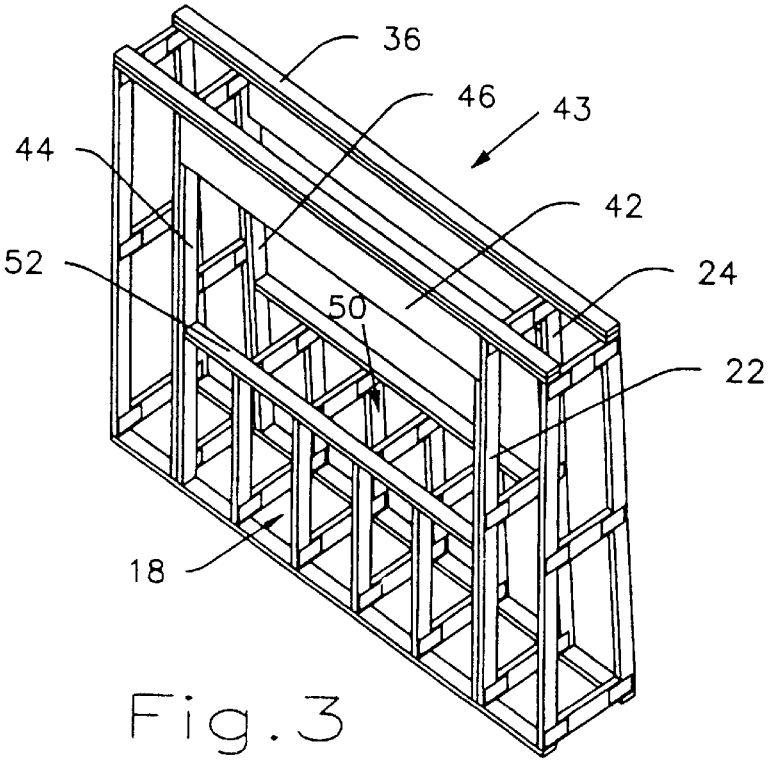
FIG. 3 is a is a perspective view of a Mediterranean or contemporary styled window wall unit assembly.

FIG. 3 is a perspective view of a Mediterranean or contemporary window wall unit assembly 43. The window wall unit assembly shown in FIG. 3 also shows the structure of the Mediterranean or contemporary door unit assembly when the lower window support 50 is deleted therefrom. If a wall unit assembly 20 further comprises: two transoms 42, one extending between a top portion of two interior studs 22, the other extending between a top portion of two exterior studs 24; two vertical shorter interior studs 44, one extending from beneath each end portion of the interior transom 42, to the lateral footer 32 therebelow; and, two upright shorter exterior studs 46, one extending from beneath each end portion of the exterior transom 42 to the footer 32 therebelow; then an opening is defined between said transoms 42 and shorter studs 44,46. When the lower window support 50 is deleted from what is shown in FIG. 3 then we have defined the structure of a door unit assembly of the type used in either a Mediterranean or contemporary architectural style.

The Mediterranean or contemporary window wall unit assembly 43 is similar to the door unit (discussed in the immediately preceeding paragraph) but further comprises a lower window support 50 comprising: two lateral members 52, one extending the width of a window between a central portion of the two shorter interior studs 46, and the other one extending the width of a window between the two shorter exterior studs 44; said lateral members 52 being seated on double stud units 18 of reduced height and having no central connecting members 31.

Figure 4:
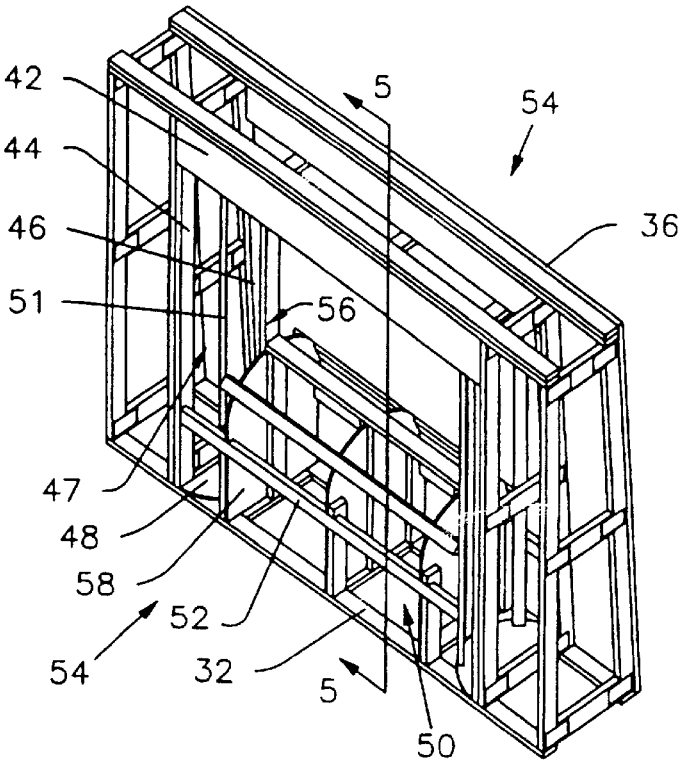
FIG. 4 is a perspective view of a Southwestern styled window wall unit assembly.

FIG. 4 is a perspective view of a Southwestern styled window wall unit assembly 54. If the window wall unit assembly 43 shown in FIG. 3 further comprises: three semi cylindrical insertions 47, each semi cylindrical insertion 47 having a diameter generally corresponding to a thickness of the wall unit assembly 43, and two semi circular end portion plates 48, and parallel longitudinal members 51 extending between peripheral portions of the semi cylindrical end portion plates 48; two of said semi cylindrical insertions 47 being sized to extend vertically beneath and between adjacent end portions of the transoms 42 and the lateral footers 32; and the other of the semi circular insertions 47 being sized to extend horizontally between the vertical cylindrical insertions 47 aforesaid, beneath the interior and exterior transoms 42; then said two semi cylindrical insertions 47 and the lateral footers 32 therebelow define a rectangular opening there between. This structure defines a door unit assembly of the type used in a Southwestern architectural style (shown in FIG. 4 when the lower window support 50 is deleted).

The Southwestern styled window unit assembly 54 is similar to the Southwestern styled door unit assembly (discussed in the immediately preceeding paragraph) but further comprises a lower window support 50 having lateral members 52 extending between the two semi cylindrical vertical insertions 56, said lateral members 52 supported by upright plates 58 having a rounded top side portion; said three semi cylindrical insertions 47 and the lower window support 50 defining a window opening there between.

Figure 5:
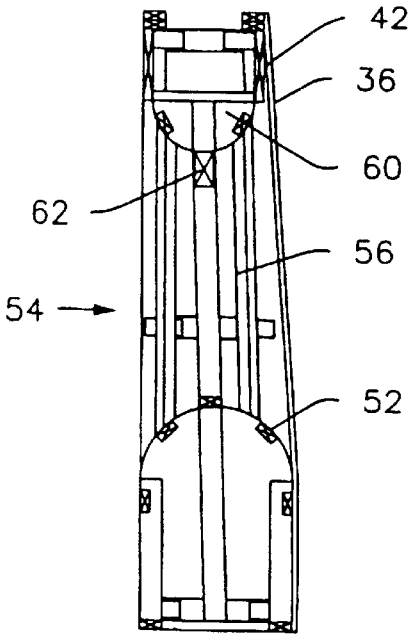
FIG. 5 is a cross sectional view of the Southwestern window wall unit assembly as viewed along line 5—5 in FIG. 4.

FIG. 5 is a cross sectional view of the Southwestern window unit assembly 54 as viewed along line 5—5 in FIG. 4. FIG. 5 best shows the horizontal semi circular insertion 60 being sized to extend horizontally between the vertical semi cylindrical insertions 56, beneath the interior and exterior transoms 42. FIG. 5 also shows an optional placement of a third transom 62 positioned beneath the horizontal semi cylindrical insertion 60, and extending between the vertical semi cylindrical insertions 56.

Most preferably in the unit assemblies 20, 43, and 54 the footers 32 and headers 34 are made of dimension lumber, said headers 34 being stacked to have a nominal thickness of 4 inches. Connecting plates 30 are used for fastening. In the most preferred embodiment sheathing (not shown) is fastened to an exterior side portion thereof, and a center connecting member 31 extends between a central portion of the interior stud 22 and the exterior stud 24 in the double stud units 18.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A double stud unit for framing a thick wall comprising:

an interior load bearing vertical stud;

an exterior upright stud;

an upper connecting member extending laterally between top end portions of the interior and exterior studs; and, a lower connecting member extending laterally between bottom end portions of the interior and exterior studs;

wherein the studs and connecting members are dimension lumber, fastened together by connecting plates.

2. The unit as in claim 1 wherein the upper connecting member is shorter than the lower connecting member so that the exterior stud slopes with respect to the interior load bearing vertical stud.

3. The unit as in claim 2 further comprising a center connecting member extending between a central portion of the interior and exterior studs.

4. A wall unit assembly for a thick walled building comprising:

a multiplicity of double stud units each unit having an interior load bearing vertical stud, and an exterior upright stud, an upper connecting member extending laterally between top end portions of the interior and exterior studs; and a lower connecting member extending laterally between bottom end portions of the interior and the exterior studs;

wherein the studs and connecting members are dimension lumber, fastened together by connecting plates; and, wherein the stud units are spaced along, and fastened above two parallel lateral footers, one positioned beneath the interior studs and the other positioned beneath the exterior studs; and, wherein the stud units are spaced along, and fastened beneath parallel headers, one positioned above the interior studs, and the other positioned above the exterior studs.

5. The wall unit assembly as in claim 4 wherein the footers and headers are dimension lumber, and wherein connecting plates are used for fastening.

6. The wall unit assembly as in claim 5 further comprising sheathing fastened to an exterior side portion thereof and further comprising a center connecting member extending between a central portion of the interior and the exterior studs.

7. The wall unit assembly as in claim 4 further comprising:

two transoms, one extending between a top portion of two interior studs, the other extending between a top portion of two exterior studs;

two vertical shorter interior studs, one extending from beneath each end portion of the interior transom, to the lateral footer therebelow; and, two upright shorter interior studs, one extending from beneath each end portion of the exterior transom to the footer therebelow;

said transoms and shorter studs defining a rectangular opening there between in the wall unit.

8. The wall unit assembly as in claim 7 further comprising:

three semi cylindrical insertions, each semi cylindrical insertion having a diameter generally corresponding to a thickness of the wall, having two semi circular end portion plates, and having parallel longitudinal members extending between peripheral portions of the semi cylindrical end portion plates;

two of said semi cylindrical insertions being sized to extend vertically beneath and between adjacent end portions of the transoms and the lateral footers; and, the other one of said semi cylindrical insertions being sized to extend horizontally between the vertical cylindrical insertions aforesaid, beneath the interior and exterior transoms;

said three semi cylindrical insertions and the lateral footers there below defining a rectangular opening thereg between.

9. The wall unit assembly as in claim 7 further comprising a lower window support comprising:

two lateral members, one extending the width of a window between a central portion of the two shorter interior studs, and the other one extending the width of a window between the two shorter exterior studs;

said lateral members being seated on double stud units of reduced height and having no central connecting members.

10. The wall unit assembly as in claim 9 wherein the footers and headers are dimension lumber, said headers being stacked to have a nominal thickness of 4 inches, and wherein connecting plates are used for fastening.

11. The wall unit assembly as in claim 10 further comprising sheathing fastened to an exterior side portion thereof and further comprising a center connecting member extending between a central portion of the interior and exterior stud.

12. The wall unit assembly as in claim 9 further comprising:

a lower window support having lateral members extending between the two semi cylindrical vertical insertions, said lateral members supported by upright plates having a rounded top side portion;

said three semi cylindrical insertions and the lower window support defining a window opening there between.

13. The wall unit assembly as in claim 12 further comprising a third transom positioned beneath the horizontal semi cylindrical insertion, and extending between the vertical semi cylindrical insertions.

14. The wall unit assembly as in claim 13 wherein the footers and headers are dimension lumber, said headers being stacked to have a nominal thickness of 4 inches, and wherein connecting plates are used for fastening.

15. The wall unit assembly as in claim 14 further comprising sheathing fastened to an exterior side portion thereof.

16. A method of framing a thick walled building comprising the steps of:

cutting an interior load bearing vertical stud;

cutting an exterior upright stud;

cutting an upper connecting member extending laterally between top end portions of the interior and exterior studs;

cutting a lower connecting member extending laterally between bottom end portions of the interior and exterior studs, said lower connecting member being cut longer than the upper connecting member so that the exterior stud slopes inwardly as it rises upwardly; and, fastening said studs and members together with mending plates.

17. The method as in claim 16 further comprising the step of cutting and fastening a center connecting member extending between a central portion of the interior and the exterior stud, and wherein the studs and connecting members are made of dimension lumber.

18. The method as in claim 17 further comprising the steps of:

spacing along, and fastening a multiplicity of double stud units above a lateral footer, positioned along a lower portion of the double stud units; and, spacing along, and fastening the multiplicity of double stud units beneath a header, positioned along a top portion of the double stud units;

so that a wall unit assembly is formed.

19. The method as in claim 18 further comprising the step of providing an opening through the wall unit assembly for a window.

20. The method as in claim 18 further comprising the step of providing an opening through the wall unit assembly for a door.

* * * * *